US008869339B2

(12) United States Patent
Howard

(10) Patent No.: US 8,869,339 B2
(45) Date of Patent: Oct. 28, 2014

(54) MOP HEAD

(71) Applicant: Vale Mill (Rochdale) Limited, Lancashire (GB)

(72) Inventor: Michael Howard, Rochdale (GB)

(73) Assignee: Vale Mill (Rochdale) Limited, Rochdale, Lancashire (GB)

( * ) Notice: Subject to any disclaimer, the term of this patent is extended or adjusted under 35 U.S.C. 154(b) by 0 days.

(21) Appl. No.: 13/965,531

(22) Filed: Aug. 13, 2013

(65) Prior Publication Data

US 2014/0047658 A1 Feb. 20, 2014

(30) Foreign Application Priority Data

Aug. 16, 2012 (GB) ..... 1214628.8

(51) Int. Cl.
*A47L 13/12* (2006.01)
*A47L 13/24* (2006.01)
*A47L 13/255* (2006.01)

(52) U.S. Cl.
CPC ..... *A47L 13/24* (2013.01); *A47L 13/255* (2013.01)
USPC ..... 15/115; 15/118; 15/228; 15/229.2

(58) Field of Classification Search
CPC ..... A47L 13/12; A47L 13/20; A47L 13/24
USPC ..... 15/115, 118, 228, 229.2
See application file for complete search history.

(56) References Cited

U.S. PATENT DOCUMENTS

| | | | | |
|---|---|---|---|---|
| 2,196,365 | A * | 4/1940 | Schulman | 15/153 |
| 2,534,086 | A * | 12/1950 | Vosbikian et al. | 15/245 |
| 2,658,218 | A * | 11/1953 | Carreiro | 401/203 |
| 3,750,218 | A | 8/1973 | Rosocha | |
| 6,085,377 | A | 7/2000 | Williams | |
| 6,836,921 | B1 | 1/2005 | Petner | |
| 7,124,464 | B2 * | 10/2006 | Williams et al. | 15/115 |

FOREIGN PATENT DOCUMENTS

| | | | |
|---|---|---|---|
| DE | 102004014371 | | 10/2005 |
| GB | 747268 | * | 3/1956 |
| JP | 48040261 U | | 5/1973 |
| WO | 96/33648 A1 | | 10/1996 |

* cited by examiner

*Primary Examiner* — Randall Chin
(74) *Attorney, Agent, or Firm* — Barlow, Josephs & Holmes, Ltd.

(57) ABSTRACT

A mop head 2 having a body 5 to which a handle 3 may be attached, and a cleaning portion 7 extending from the body 5 and intended, in use, to clean a dirty surface. The mop head 2 has a formation 17 extending from the rest of the body 5, said formation 17 having an edge or surface 19 which is intended, in use, to clean the dirty surface. The surface may be curved. The surface 19 may comprise one or more formations 20 for cleaning the dirty surface.

22 Claims, 8 Drawing Sheets

MOP HEAD

CROSS-REFERENCE TO RELATED APPLICATION

This patent document claims priority to earlier filed British Patent Application Serial Number 1214628.8, filed on Aug. 16, 2012, the entire contents of which are incorporated herein by reference.

TECHNICAL FIELD OF THE INVENTION

The present invention relates to mop heads for mops such as string mops.

BACKGROUND TO THE INVENTION

Conventional string mops typically comprise a mop head made from plastics material, a number of microfibre or cloth strips or 'strings' attached to and extending from the head and a stick handle which is screwed into the mop head or attached using a plastic snap fit to enable easy handling of the mop. The mop head usually comprises a cylindrical section for receiving an end of the handle in a screw fit and a substantially hollow, dome shaped section to which the strings are attached. The dome shape is such that the strings extend out from the mop head and hang in a splayed out fashion to maximise the cleaning surface area of the mop.

A problem with conventional string mops is that they are not particularly well suited to removing scuff marks and stubborn stains which generally require a strong abrasive action. One solution to this problem has been proposed which involves including as part of the string bunch certain strings comprising a more abrasive material than other strings which may be used to specifically target stubborn stains. A problem with such mops is that they can still fail to provide sufficient friction to remove stubborn stains.

It is an objective of embodiments of the present invention to provide an improved mop that has better stain removing capabilities.

SUMMARY OF THE INVENTION

According to an aspect of the present invention, there is provided a mop head comprising a body to which a handle may be attached, and a cleaning portion extending from the body to clean a dirty surface, the mop head comprising a formation extending from the body, said formation having a surface which may be used to clean the dirty surface.

Advantageously, the formation may be used to apply pressure and increased friction to stubborn stains that the cleaning portion cannot ordinarily remove. Thus the formation adds an additional cleaning capability to the mop head and enables it to remove stains from a surface that conventional mops cannot. The formation also adds an ability to clamp the cleaning portion between the mop head and the surface to be cleaned so that increased pressure can be applied to the cleaning portion to enhance its stain removing capabilities.

At least a part of the body may define a boundary and the formation may extend away from the boundary. The boundary may define a dome shape.

The surface of the formation may be shaped and configured to permit the mop to pivot about the formation. The surface is curved. The surface may comprise one or more elements to enhance the cleaning properties of the surface. The elements may comprise raised portions that extend from the surface. The elements may comprise ribs. The elements may comprise an abrasive material. The elements may be positioned on the curved surface to be most effective at cleaning when the mop comprises a mop handle and the handle is pivoted about the formation between the angles of 20 degrees and 50 degrees to the surface to be cleaned.

The surface may comprise a soft material. The surface may comprise a rubber material. At least a part of the body may comprise the material. The body may have a base and the material may extend at least partially around the circumference or perimeter of the base.

One or more holes or slots may be formed through the body between the formation and the body.

The body may comprise a fitting for receiving a handle. A handle may be fitted to the body. The handle may be a pole. The handle may be telescopic.

The cleaning section may comprise one or more microfibre strips. The cleaning section may comprise a bundle of strings, yarns and/or strips of cloth. Alternatively, the cleaning section may comprise a pad such as a sponge or fabric pad.

There may be a mop comprising a mop head according to the above described aspect of the present invention.

DETAILED DESCRIPTION OF THE INVENTION

In order that the invention may be more clearly understood an embodiment thereof will now be described, by way of example only, with reference to the accompanying drawings, of which:

Figure 1:
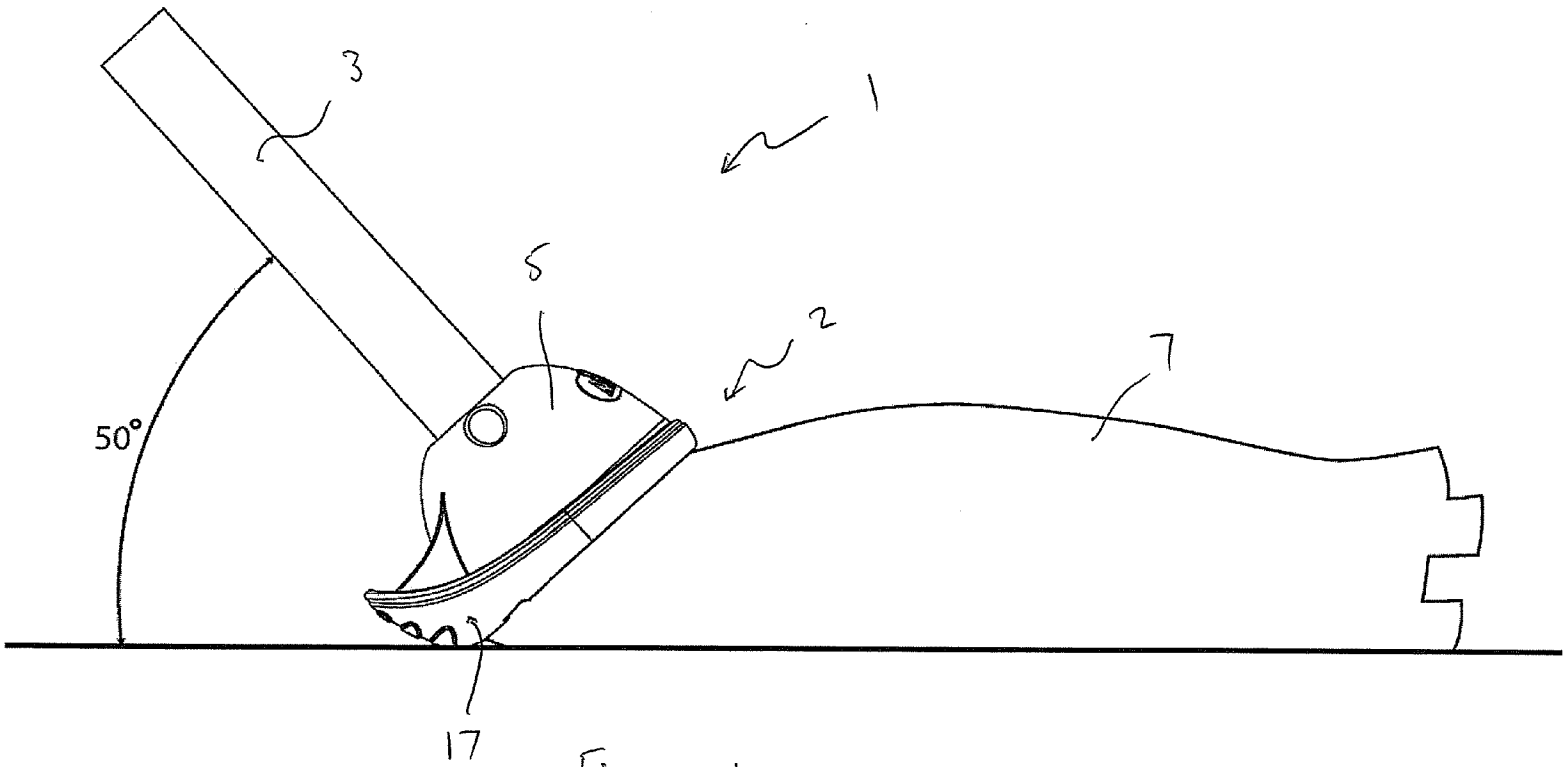
FIG. 1 is a side view of a mop comprising a mop head according to the present invention.
Figure 3:
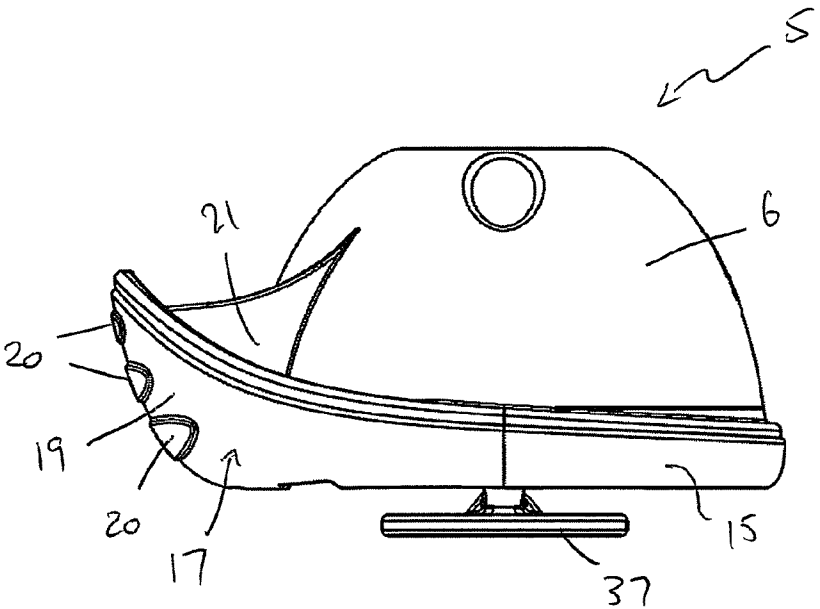
FIG. 3 is a side view of the part of the mop head shown in FIG. 2.
Figure 2:
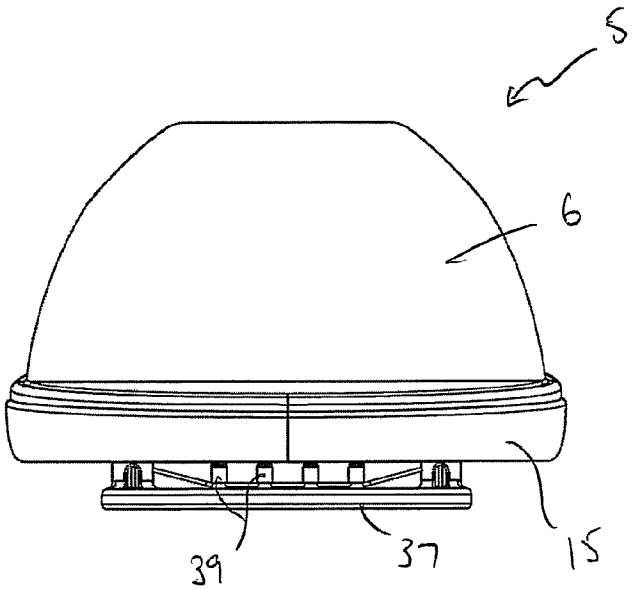
FIG. 2 is a rear view of a part of the mop head shown in FIG. 1.
Figure 5:
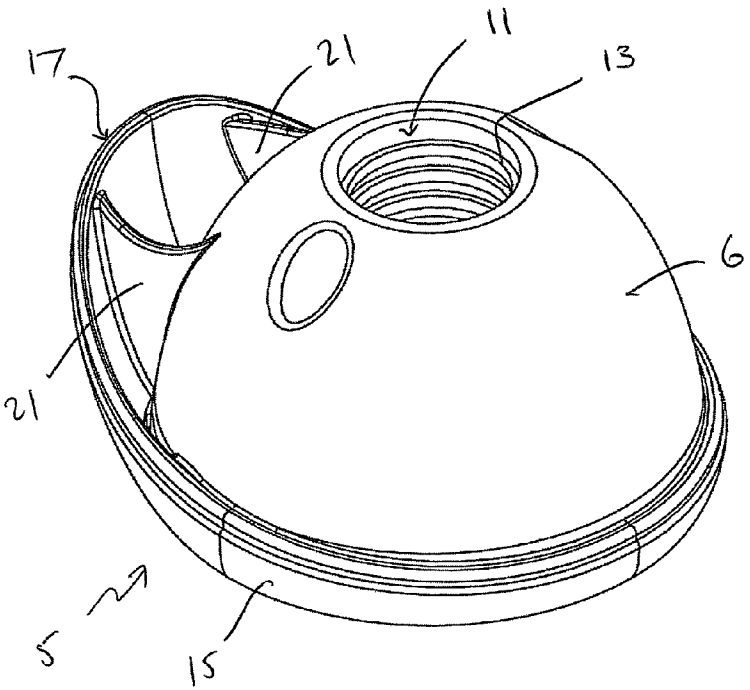
FIG. 5 is a perspective top side view of the part shown in FIG. 2.
Figure 4:
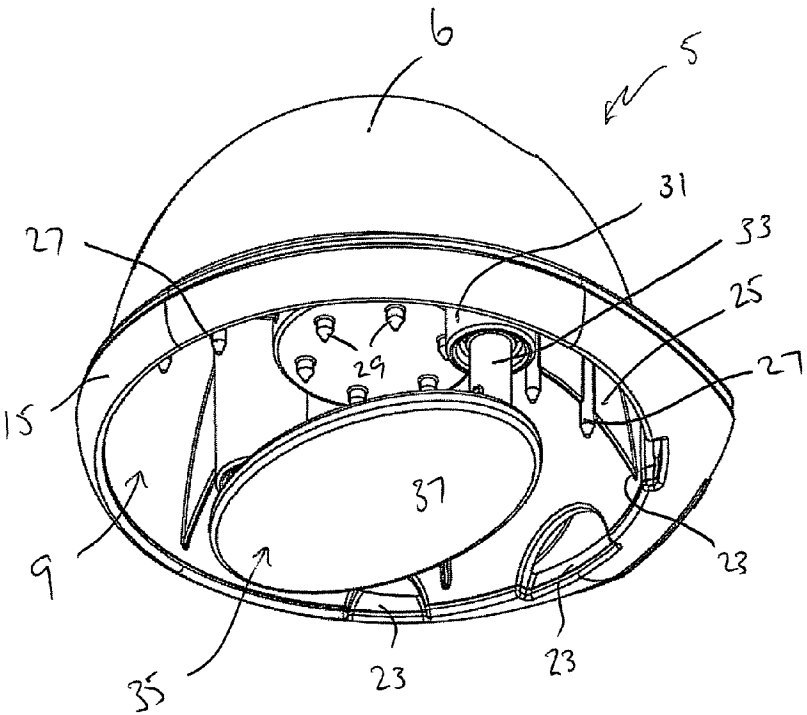
FIG. 4 is a perspective underside view of the part shown in FIG. 2.
Figure 7:
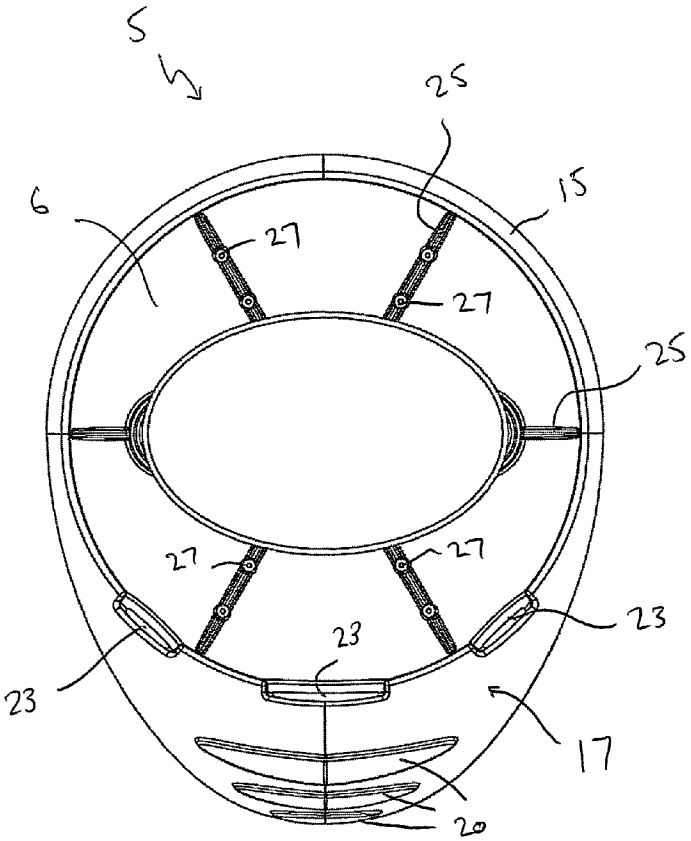
FIG. 7 is an underside view of the part shown in FIG. 2.
Figure 6:
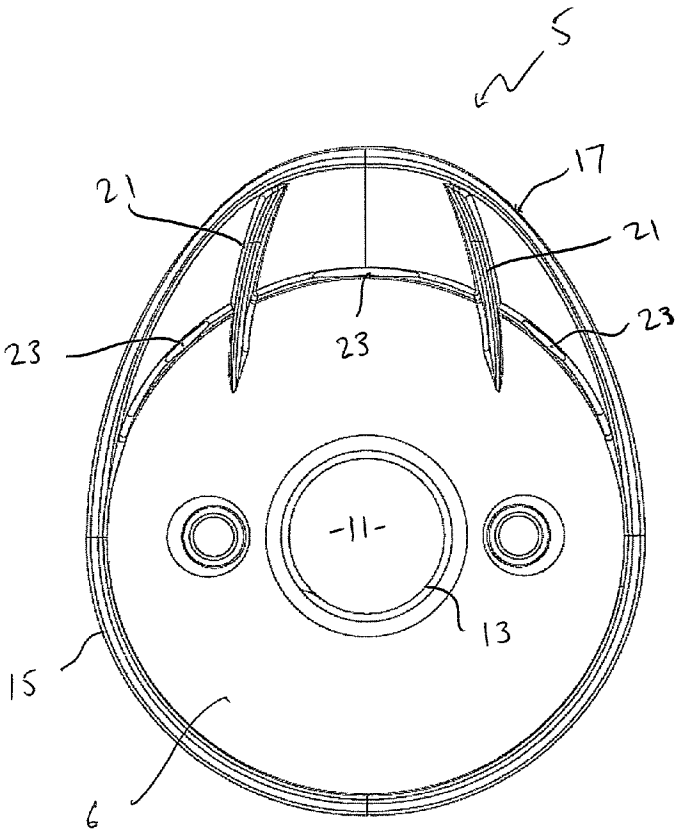
FIG. 6 is a plan view of the part shown in FIG. 2.
Figure 10:
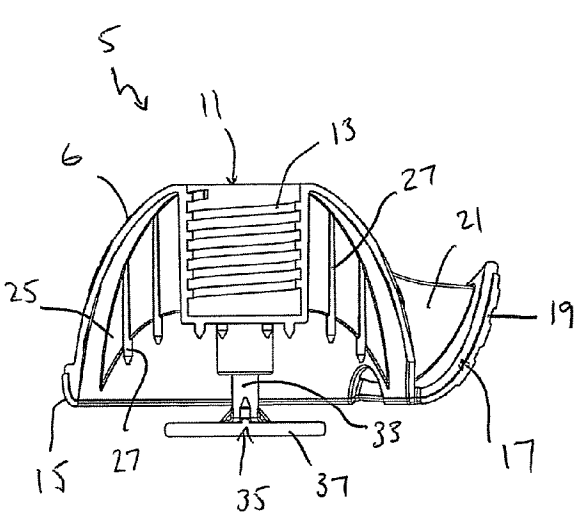
FIG. 10 is an alternative cross-section view of the part shown in FIG. 2.
Figure 9:
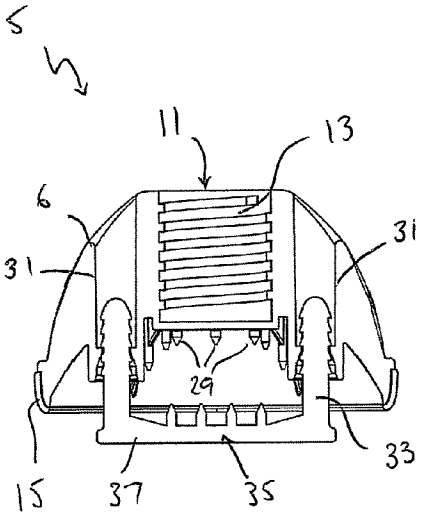
FIG. 9 is a cross-section view of the part shown in FIG. 2.
Figure 8:
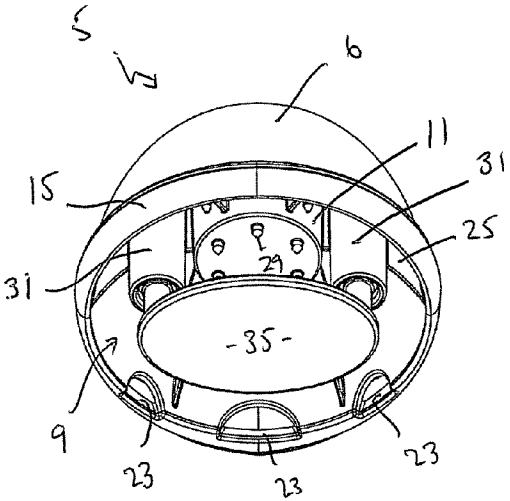
FIG. 8 is a perspective rear underside view of the part shown in FIG. 2.

With reference to the drawings there is shown a mop 1 comprising a mop head 2 and a telescopic stick or pole 3. The mop head 2 comprises a body 5 and a number of microfibre strips 7 which are attached to the body 5 and which collectively form a cleaning portion of the mop head 2.

The main part of the body 5 is a substantially hollow dome 6 comprising an open substantially circular base 9. A hollow substantially cylindrical recess 11 which is closed at one end extends into the dome 6 from the top. A helical groove 13 is formed along the inner wall of the recess 11 and is configured to receive a corresponding helical thread on the end of the mop handle 3. Thus, the handle 3 and mop head 2 can be connected together with a screw fit.

The body 5 further comprises a lip 15 that extends around the outside circumference of the base 9 and, at one side, projects from the side of the dome 6 to create a formation 17.

The formation 17 comprises a curved surface 19 which extends upwardly from the lip 15, tapering at the top, such that there is a gap between the wall of the dome 6 and the inside wall of the formation 17. The curved surface 19 is shaped such that it becomes steeper the further it extends away from the dome 6. A pair of reinforcing ribs 21 which are integral to the body 5 extend between the wall of the dome 6 and the inside wall of the formation so that the formation 17 is resistant to flexing when subjected to external forces.

Three narrow slots 23 are formed through the body 5 at the interface between the inner wall of the formation 17 and the wall of the dome 6. The slots 23 are provided for drainage between the formation 17 and the dome 6 and, thus, prevent water from pooling in the region between the two.

The outer facing side of the lip 15 and curved surface 19 are formed from a soft rubber material, separately from the formation 17 and the rest of the body 5 which is made from injection moulded plastics material, using a dual shot manufacturing process. The soft rubber material is provided to limit damage to other items and surfaces that may come into contact with the lip 15 and curved surface 19 of the body 5 during use. Three cleaning pads 20 are formed integrally with and project from the curved surface 19. The cleaning pads 20 are intended to be used to scrub stubborn stains on surfaces that cannot ordinarily be removed by the action of the microfibre strips 7 alone. Although cleaning pads 20 are shown in this embodiment, it is envisaged that other materials and replaceable attachments could be provided on the curved surface 19 such as bristles or abrasive wool pads.

The underside of the dome 6 comprises six radially spaced strengthening fins 25 which extend between the sidewall of the recess 11 and the inner wall of the dome 6. Four of the fins 25 comprise a pair of studs 27 which extend beyond the edge of the respective fins 25 to provide a point of attachment for the microfibre cleaning strips 7. Six shorter studs 29 are radially spaced around the lower side of the recess 11 and again provide a point of attachment for the strips 7. The remaining two fins 25 are arranged on opposite sides respectively of the dome 6 and comprise two hollow cylindrical formations 31 which extend through the wall of the dome 6. The hollow cylinders provide a female receptacle for correspondingly shaped male pins 33 which are formed as part of a retaining bracket 35. The male pins 33 are shaped and configured to be inserted into the female receptacles 31 and held in place via cooperating stepped edges on the walls of the female and male parts respectively.

The retaining bracket 35 comprises an elliptical plate 37 which, when the bracket 35 is attached to the dome 6 and the microfiber strips 7 are clamped between the bracket and the dome 6, serves to direct the microfiber strips 7 through the gap in the base 9 in an outward, splayed fashion. A number of upwardly facing studs 39 project from the inner face of the circular plate 37 to help retain the microfibre strips 7 against the body 5.

Figure 11:
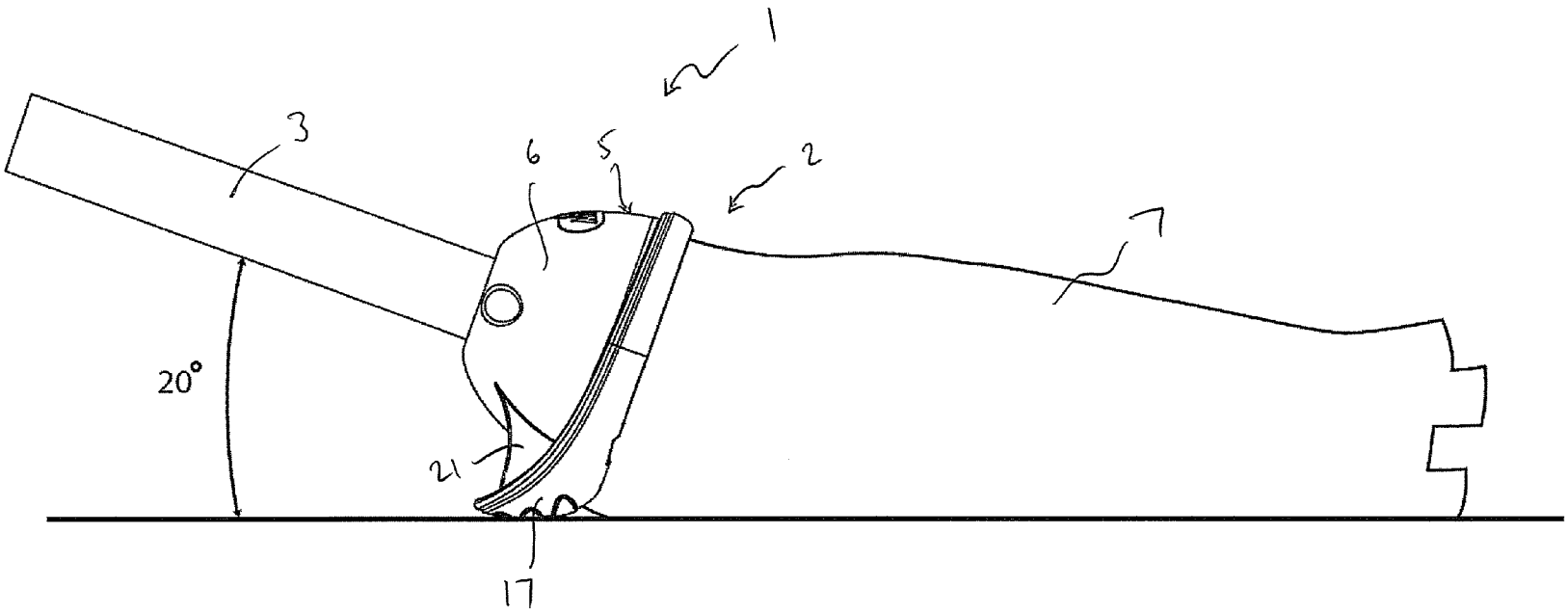
FIG. 11 is a side view of a mop comprising a mop head according to the present invention.
Figure 12:
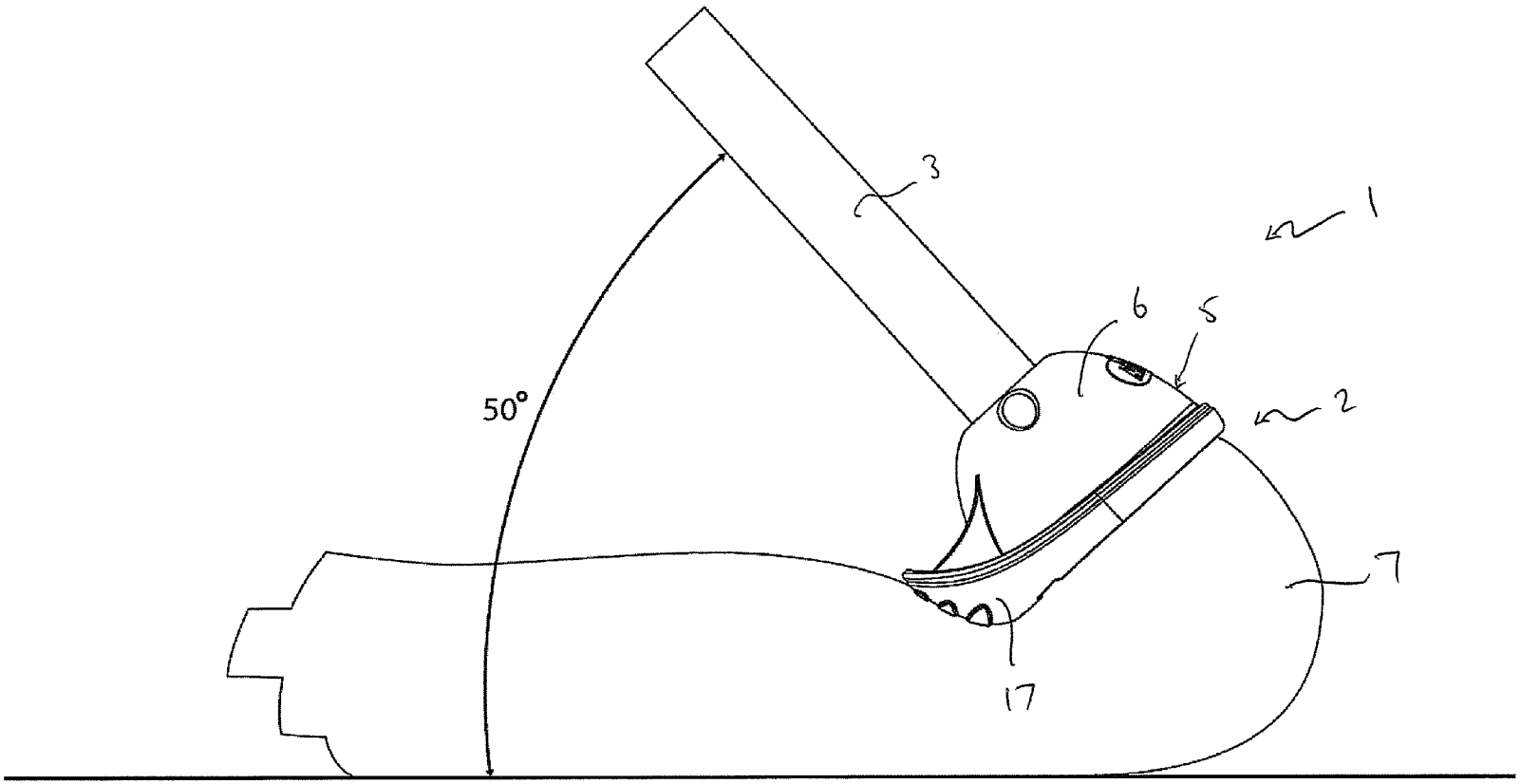
FIG. 12 is a side view of the mop shown in FIG. 11 at a different angle.
Figure 13:
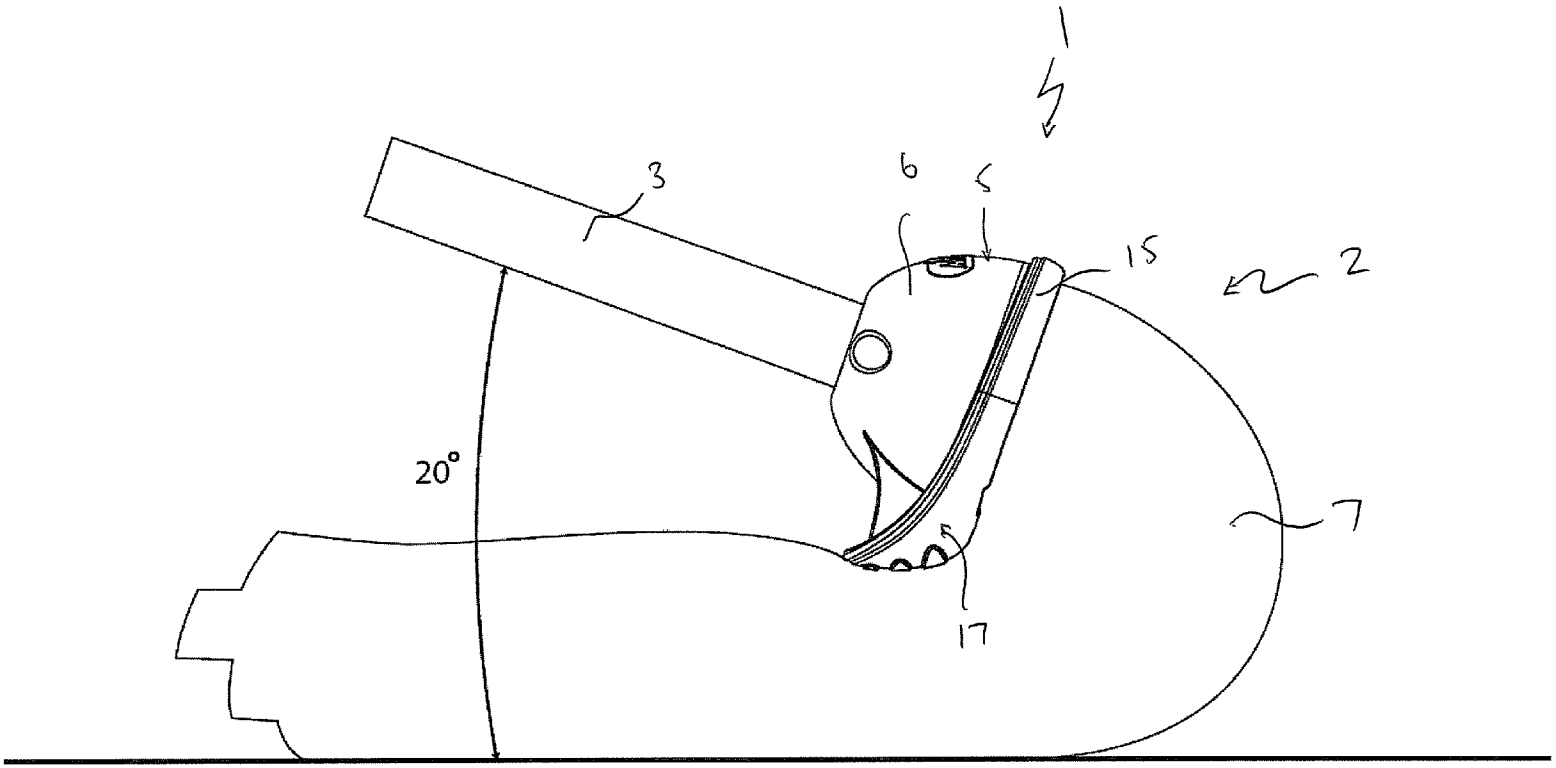
FIG. 13 is a side view of the mop shown in FIG. 11 at another angle.

In use, the telescopic handle 3 is adjusted to the required height for the user and the mop head 2 is positioned with the microfibre strips 7 in contact with a surface to be cleaned. For particularly stubborn stains, the mop 1 is rotated until the curved surface 19 and the cleaning pads 20 are in contact with the stain so that it can be removed with a sustained scrubbing action. The curved surface 19 enables the mop 1 to pivot so that the user does not have to continually change position or stoop to change the angle of the mop handle relative to the surface, and hence, the portion of the curved surface acting on the stain. As can be seen in FIGS. 1 and 11, the portion of the curved surface acting on the stain can be easily and conveniently adjusted by pivoting the mop handle 3 about the curved surface 19, optimally, from between 20 degrees to 50 degrees. Other angles are envisaged.

Where it is desired to use the microfibre strips 7 to clean a surface but with a more even distribution of force acting on the strips 7, the microfibre strips 7 may be positioned between the surface to be cleaned and the curved surface 19 of the formation 17. The pivoting action of the mop 1 about the curved surface permits a controlled cleaning and scrubbing action. It also permits greater or less force to be applied to the strips 7 by pivoting and changing the angle of the mop 1 relative to the surface thereby changing the area of the curved surface 19 acting on the strips 7. The formation 17 also enables the strips 7 to be clamped between the formation and the surface to be cleaned, thus maintaining the strips 7 in an even distribution when moved toward and away from the user, thereby helping to maximise the cleaning effect of the mop 1.

The above embodiment is described by way of example only. Many variations are possible without departing from the scope of the invention as defined in the appended claims.

The invention claimed is:

1. A mop head comprising:

a body portion configured and arranged to receive a handle, and a cleaning portion extending from the body portion to clean a dirty surface, the mop head further comprising a formation extending from the body portion, said formation having a cleaning surface which may be used to clean the dirty surface, wherein the cleaning surface comprises one or more raised cleaning portions that are integrally formed with and project from the cleaning surface, wherein at least a part of the formation is spaced from the body portion such that a gap is formed between the formation and the body portion, the formation comprises a curved surface which extends away from and adjacent to a sidewall of the body portion and wherein the cleaning surface is formed separately from the formation and conforms substantially to at least a part of the curved surface of the formation.

2. A mop head as claimed in claim 1, wherein at least a part of the body portion defines a boundary and the formation extends away from the boundary.

3. A mop head as claimed in claim 2, wherein the boundary defines a dome shape.

4. A mop head as claimed in claim 1, wherein the cleaning surface of the formation is shaped and configured to permit the mop head to pivot about the formation.

5. A mop head as claimed in claim 1, wherein the cleaning surface is curved.

6. A mop head as claimed in claim 5, wherein the one or more raised cleaning portions are positioned on the curved cleaning surface to be most effective at cleaning when the mop head is pivoted about the formation between the angles of 20 degrees and 50 degrees to the dirty surface to be cleaned.

7. A mop head as claimed in claim 1, wherein the one or more raised cleaning portions comprise ribs.

8. A mop head as claimed in claim 1, wherein the one or more raised cleaning portions comprise an abrasive material.

9. A mop head as claimed in claim 1, wherein the cleaning surface comprises a soft material.

10. A mop head as claimed in claim 9, wherein at least a part of the rest of the body portion comprises the soft material.

11. A mop head as claimed in claim 10, wherein the body portion has a base and the soft material extends at least partially around the circumference or perimeter of the base.

12. A mop head as claimed in claim 1, wherein the cleaning surface comprises a rubber material.

13. A mop head as claimed in claim 1, wherein one or more holes are formed through the body portion between the formation and the body portion.

14. A mop head as claimed in claim 1, wherein the body portion comprises a fitting configured and arranged to receive a handle.

15. A mop head as claimed in claim 1, wherein the cleaning portion comprises one or more microfibre strips.

16. A mop head as claimed in claim 1, wherein the cleaning portion comprises a pad.

17. A mop head as claimed in claim 1 further comprising one or more struts extending in the gap from the body portion to the formation.

18. A mop comprising:

a handle, and a mop head comprising a body portion having a fitting configured and arranged to receive said handle, said mop head further comprising a cleaning portion extending from the body portion to clean a dirty surface, and a formation extending from the body portion, said formation having a cleaning surface which may be used to clean the dirty surface, wherein the cleaning surface comprises one or more raised cleaning portions that are integrally formed with and project from the cleaning surface, wherein at least a part of the formation is spaced from the body portion such that a gap is formed between the formation and the body portion, the formation comprises a curved surface which extends away from and adjacent to a sidewall of the body portion and wherein the cleaning surface is formed separately from the formation and conforms substantially to at least a part of the curved surface of the formation.

19. A mop as claimed in claim 18, wherein the cleaning surface is curved, the one or more raised cleaning portions are positioned on the curved cleaning surface to be most effective at cleaning when the mop head is pivoted about the formation between the angles of 20 degrees and 50 degrees to the dirty surface to be cleaned.

20. A mop as claimed in claim 19, wherein the one or more raised cleaning portions comprise an abrasive material.

21. A mop as claimed in claim 18, wherein the one or more raised cleaning portions comprise an abrasive material.

22. A mop head comprising:

a body portion configured and arranged to receive a handle, and a cleaning portion extending from the body portion to clean a dirty surface, the mop head further comprising a formation extending from the body portion, said formation having a cleaning surface which may be used to clean the dirty surface, wherein the cleaning surface comprises one or more raised cleaning portions that are integrally formed with and project from the cleaning surface, and wherein one or more holes are formed through the body portion and/or the formation at a region between the formation and the body portion.

* * * * *